United States Patent [19]

Valdo

[11] 3,958,979

[45] May 25, 1976

[54] METALLURGICAL PROCESS FOR PURIFYING ALUMINUM-SILICON ALLOY

[75] Inventor: Alex R. Valdo, Phoenix, Ariz.

[73] Assignee: Ethyl Corporation, Richmond, Va.

[22] Filed: Sept. 12, 1975

[21] Appl. No.: 612,939

Related U.S. Application Data

[63] Continuation-in-part of Ser. No. 424,842, Dec. 14, 1973, which is a continuation of Ser. No. 212,378, Dec. 27, 1971, abandoned, which is a continuation of Ser. No. 32,326, April 27, 1970, abandoned, which is a continuation-in-part of Ser. No. 26,751, April 8, 1970, abandoned.

[52] U.S. Cl. ..... 75/63; 75/68 A; 75/93 AC; 75/135

[51] Int. Cl.[2] ..... C22B 21/06

[58] Field of Search ..... 75/68 R, 68 A, 63, 135, 75/148, 93 A

[56] References Cited

UNITED STATES PATENTS

| | | | |
|---|---|---|---|
| 2,930,676 | 3/1960 | Byrns | 75/148 X |
| 2,974,032 | 3/1961 | Grunert et al. | 75/68 A |
| 3,083,093 | 3/1963 | Grunert | 75/63 |
| 3,198,625 | 8/1965 | Stroup | 75/63 |

FOREIGN PATENTS OR APPLICATIONS

| | | | |
|---|---|---|---|
| 964,792 | 7/1964 | United Kingdom | 75/68 R |

*Primary Examiner*—M. J. Andrews
*Attorney, Agent, or Firm*—Donald L. Johnson; John F. Sieberth; Paul H. Leonard

[57] ABSTRACT

A method of processing an impure aluminum base alloy containing a substantial amount of silicon and a deleterious amount of titanium, which includes melting the alloy and stirring the molten alloy with a molten fluoride flux less dense than the alloy and having a boiling point above the alloy's liquidus temperature, then permitting the stirred mixture to stand to settle out a molten alloy in which the titanium content is reduced but not entirely eliminated, and separating the settled out alloy from the flux.

2 Claims, No Drawings

METALLURGICAL PROCESS FOR PURIFYING ALUMINUM-SILICON ALLOY

CROSS REFERENCES TO RELATED APPLICATIONS

This is a continuation-in-part of application Ser. No. 424,842 filed Dec. 14, 1973, now pending, which is a continuation of application Ser. No. 212,378, filed Dec. 27, 1971, now abandoned, which is a continuation of application Ser. No. 32,326, filed Apr. 27, 1970, now abandoned, which in turn is a continuation-in-part of application Ser. No. 26,751, filed Apr. 8, 1970, now abandoned.

BACKGROUND OF THE INVENTION

The present invention is in the field of non-ferrous metallurgy and relates particularly to the refining of aluminum-silicon alloys.

Titanium, carbon and/or oxygen cause deleterious effects to the processability, corrosion resistance and other desirable characteristics of aluminum. It is therefore important that their content be reduced to an acceptable level.

The present invention provides an economical method for removing these undesirable elements, titanium, carbon and oxygen, and other impurities from aluminum-silicon alloys or aluminum base alloys containing substantial amounts of silicon. It is considerably less costly than other known pyrometallurgical or extractive metallurgical processes.

Another advantage of the present invention over prior art processes is that utilization of residual heat is permitted.

Another advantage of the present invention is that the fluxes may be recycled.

SUMMARY OF THE INVENTION

The present invention relates primarily to a method for refining aluminum-silicon alloys for removing titanium, carbon and oxygen and other impurities. In carrying out the invention, a mixture of fluxes or a standard flux is added to a molten aluminum-silicon alloy containing the undesired impurities. The flux is added to the alloy at a temperature below the lowest boiling point of the flux ingredients. The molten mixture of flux and alloy is stirred and the mixture of flux and impurities is allowed to form on the surface. Removal of the flux impurities may be accomplished by decanting, siphoning or allowing the impurities to solidify wherein they can readily be removed. The flux may then be cleaned by filtering and recycled.

The flux or flux composition may be a material such as cryolite or may be a mixture of an aluminum fluoride compound with one or more of a sodium, lithium, or potassium chloride or fluoride. An example of a preferred composition is as follows:

Cryolite: 5–100%
Sodium chloride: 0–95%
Potassium chloride: 0–95%

These percentages are by weight.

Some examples of other suitable flux compositions are:

1. $LiF—AlF_3$ (85% LiF—15% $AlF_3$; 64% LiF—36% $AlF_3$)
2. $LiF—NaF—AlF_3$ (39.1% LiF—39.1% NaF—21.8% $AlF_3$)
3. $NaF—AlF_3$ (53% NaF—47% $AlF_3$)

4. $NaF—KF—AlF_3$ (32% NaF—48% KF—20% $AlF_3$)
5. $KF—AlF_3$ (55% KF—45% $AlF_3$)
6. $KF—LiF—AlF_3$ (47.5% KF—47.5% LiF—5% $AlF_3$)
7. $LiCl—KCl—Na_3AlF_6$ (48% LiCl—32% KCl—20% $Na_3AlF_6$)
8. $LiCl—NaCl—Na_3AlF_6$ (56% LiCl—24% NaCl—20% $Na_3AlF_6$)

These compositions are shown in mole-percent.

Other suitable fluxes may be used without departing from the scope of the invention. The flux must be one, however, which does not excessively contaminate the aluminum-silicon alloy or undergo a chemical reaction with the alloy to introduce undesirable metal impurities. The boiling point of an ideal flux is one which is above the liquidus temperature of the alloy. A boiling point of about 200°C above the liquidus temperature of the molten aluminum-silicon alloy is particularly desirable. In an aluminum-silicon alloy having a low or minimal viscosity at 1200°C or higher, a flux having a boiling point of about 1400°C would be especially useful.

A preferred flux is one which has a sufficiently high boiling point to permit use of a temperature at which the alloy is sufficiently liquid that rapid and efficient separation of the flux and alloy phases is favored. The process is operated at a temperature which provides the desired low or minimal viscosity to promote phase separation.

DESCRIPTION OF THE PREFERRED EMBODIMENT OF THE INVENTION

A flux composition comprising cryolite, sodium chloride and potassium chloride has been found to be particularly suitable for reducing titanium, carbon and oxygen impurities in aluminum-silicon alloys. In one preferred form of the invention, a flux composition comprising 47.5 weight percent NaCl, 47.5 weight percent KCl, and 5 weight cryolite is added to a molten silicon alloy containing impurities of titanium, carbon and oxygen at a temperature below the lowest boiling point of the flux ingredients. The molten mixture of flux and alloy is then stirred and a mixture of flux plus impurities is allowed to form on the surface. The flux impurities are then removed by decanting or by allowing the mixture of flux and impurities to solidify and then removing therefrom. Preferably, the flux is then cleaned and recycled. A preferred ratio of flux:alloy is 1:1. Any other suitable ratio of flux to alloy may be used.

Fluxes or flux compositions which have been found to be particularly preferable are those comprising cryolite, sodium chloride and potassium chloride wherein the compounds are distributed in weight percent from about 5–20 percent, 40–47.5 percent, and 40–47.5 percent, respectively.

A variety of tests have been made showing the large reduction of impurities in aluminum-silicon alloys.

EXAMPLE I

An aluminum-silicon alloy containing impurities as follows was tested with various flux compositions:

| Elements | Wt. % by X-Ray Fluorescence (XRF) |
|---|---|
| Al | 62.7 |
| Si | 23.4 |
| Fe | 2.8 |
| Ti | 3.3 |
| C | 3.6 |

-continued

| Elements | Wt. % by X-Ray Fluorescence (XRF) |
|---|---|
| O | 3.4 |
| Total | 99.2 |

In the test procedure, 100 grams of the aluminum-silicon alloy was charged into a graphite crucible in an electric resistance furnace. Previous tests indicated that the best fluid temperature or temperature of minimum viscosity was about 1200°C. One hundred grams of each of several fluxes were added to the molten alloy, the mixture of alloy and flux was heated to the desired temperature, stirred several times and allowed to cool slowly in the crucible. The solidified flux was separated from the alloy very easily and cleanly. The alloy was then analyzed by X-ray Fluorescence. Carbon content was determined by the Leco Combustion or Furnace Method and oxygen content was determined by the Neutron Activation Method. These are all standard methods of analyses well known to those skilled in the analytical art. The result of these tests are shown in Table I.

TABLE I

Flux Treatments for Ti, C and O Removal

| Run No. | Flux | Melt Temp., °C | Al | Si | Fe | Ti | C** | O*** |
|---|---|---|---|---|---|---|---|---|
| | | | Percentages by Weight X-Ray Fluorescence | | | | | |
| 1* | — | — | 62.7 | 23.4 | 2.8 | 3.3 | 3.6 | 3.4 |
| 2 | (a) | 1175–1400 | 60.4 | 22.4 | 3.7 | 2.0 | 1.14 | 2.89 |
| 3 | (b) | 1155 | 65.5 | 22.1 | 2.4 | 2.0 | 0.82 | 0.61 |
| 4 | (b) | 1100 | 65.6 | 21.2 | 2.6 | 1.7 | 0.54 | 0.81 |
| 5 | (c) | 1110 | 69.5 | 21.1 | 2.1 | 1.4 | 0.1 | 0.43 |
| 6 | (c) | 1105 | 68.6 | 23.9 | 3.4 | 2.0 | 0.2 | 0.57 |
| 7 | (d) | 1100 | 70.8 | 22.4 | 2.6 | 1.6 | 2.62 | 0.62 |
| 8 | (d) | 1200 | 63.6 | 22.5 | 2.9 | 1.8 | 0.90 | 1.63 |

*Control Sample
**Leco furnace method
***Neutron activation method
(a) $Na_3AlF_6$
(b) 47.5% NaCl + 47.5% KCl + 5% $Na_3AlF_6$
(c) 45% NaCl + 45% KCl + 10% $Na_3AlF_6$
(d) 40% NaCl + 40% KCl + 20% $Na_3AlF_6$

EXAMPLE II

An alloy, comprising 63 percent aluminum, 33 percent silicon, 2.6 percent iron and 1.6 percent titanium was treated with a flux comprising 40 percent sodium chloride, 40 percent potassium chloride and 20 percent cryolite. All percentages of alloy are by weight by X-ray fluorescence. Percentages of flux ingredients are by weight. One hundred grams each of alloy and flux were heated to a temperature of 1150°C in a graphite crucible, stirred several times, and allowed to cool slowly in the crucible. The solidified flux was separated from the alloy very easily and cleanly. X-ray fluorescence analyses of the alloy are as follows:

TABLE II

| Runs | Weight % | | | |
|---|---|---|---|---|
| | Al | Si | Fe | Ti |
| Control | 63.0 | 33.0 | 2.6 | 1.6 |
| (1) | 59.8 | 31.6 | 2.1 | 0.6 |
| (2) | 62.1 | 28.9 | 2.3 | 0.5 |

Additional tests were run wherein the flux:alloy ratios and flux compositions were varied. The test procedures were substantially identical to those reported hereinabove, mainly, heating and melting in a graphite crucible to a temperature of 1150°C, stirring several times, then slowly cooling the melt to ambient temperature. The results of these tests are recorded hereinafter in Examples III–V.

EXAMPLE III

One hundred grams of flux (40 percent sodium chloride, 40 percent potassium chloride, and 20 percent cryolite — percent by weight) to 50 grams of alloy reduced titanium content of alloy approximately 60 percent by weight.

EXAMPLE IV

A 1:1 mixture of flux (47.5 percent sodium chloride, 47.5 percent potassium chloride, and 5 percent cryolite — percent by weight) to alloy was used. Again, approximately 60 percent of the titanium was removed.

EXAMPLE V

A 1:1 mixture of flux (45 percent sodium chloride, 45 percent potassium chloride and 10 percent cryolite — percent by weight) to alloy was used. Again, approximately 60 percent of the titanium was removed.

The results of Example III, IV and V are set forth hereinafter in Table III:

TABLE III

| | Weight % | | | |
|---|---|---|---|---|
| | Al | Si | Fe | Ti |
| Control | 63.0 | 33.0 | 2.6 | 1.6 |
| Ex. III | 59.0 | 30.9 | 2.5 | 0.6 |
| Ex. IV | 59.8 | 33.0 | 2.7 | 0.6 |
| Ex. V | 58.4 | 32.3 | 2.5 | 0.6 |

EXAMPLE VI

The procedures of the foregoing Examples III - V are carried out except that the flux used is 85 percent LiF and 15 percent $AlF_3$ (mole percent) and the ratio of flux to alloy is 1:1. Titanium removal is effective.

EXAMPLE VII

The procedures of Example VI are followed except that the flux used is 48 percent LiCl, 32 percent KCl and 20 percent $Na_3AlF_6$ (mole percent). Similar results are obtained.

EXAMPLE VIII

The procedure of Example VI is followed except that the flux used is 47.5 percent KF, 47.5 percent LiF and 5 percent $AlF_3$ (mole percent). Comparable results are obtained.

EXAMPLE IX

The procedure of Example VI is followed except that the following fluxes are used in individual runs (percentages by weight)

a. 40% NaF, 40% KF and 20% $Na_3AlF_6$ b. 45% NaF, 45% KF and 10% $Na_3AlF_6$ c. 47.5% NaF, 47.5% KF and 5% $Na_3AlF_6$ Comparable results are obtained.

A series of tests were made wherein no flux was used at relatively high temperatures and a flux was used at relatively lower temperatures. When the aluminum alloy was melted at 1300° and 1450°C, without flux additions, there was approximately a 66 percent decrease in titanium content. The same magnitude in decrease was noted when the alloy was melted at 900° and 1025°C with a 1:1 flux mixture, and at 1150°C with a 0.5:1 flux to alloy mixture. The flux used in the test was 45 percent sodium chloride, 45 percent potassium chloride and 10 percent cryolite, percentages by weight. The results of these tests are set forth hereinafter in Table IV.

TABLE IV

| Run | Al-Si Alloy - Refining Al | Si | Fe | Ti |
|---|---|---|---|---|
| 1 | 63.0 | 33.0 | 2.6 | 1.6 |
| 2 | 59.2 | 30.0 | 2.5 | 0.5 |
| 3 | 57.3 | 34.2 | 2.7 | 0.5 |
| 4 | 64.9 | 31.3 | 2.5 | 0.5 |
| 5 | 60.8 | 33.2 | 2.7 | 0.5 |

TABLE IV-continued

| Run | Al-Si Alloy - Refining Al | Si | Fe | Ti |
|---|---|---|---|---|
| 6 | 61.1 | 34.1 | 2.7 | 0.5 |

NOTES:
1 Control sample
2 Melt temps. 1300°C–1450°C respectively - no flux
3 Melt temps. 1300°C–1450°C respectively - no flux
4 Melt temps. 1025°C - 1.1 mixture - flux
5 Melt temps. 900°C - 1:1 mixture - flux
6 Melt temps. 1150°C - 0.5:1 mixture - flux From the foregoing examples it can readily be seen that the addition of a flux to a molten aluminum-silicon alloy provides a convenient means for reducing the titanium, carbon and oxygen content of aluminum-silicon alloys, therefore considerably enhancing the value of such alloys.

From the foregoing examples it is also seen that the impure aluminum base alloy or aluminum-silicon alloy contains at least about 23 percent (23.4 percent). silicon and that titanium is present in an amount of at least about 1.6 percent.

The foregoing disclosure and description of the invention is illustrative and explanatory thereof and various changes can be made within the scope of the appended claims, without departing from the spirit of the invention.

What is claimed is:

1. A method of processing an impure aluminum base alloy containing at least about 23 percent silicon and at least about 1.6 percent titanium, which method includes the step of melting the alloy and stirring the molten alloy with at least half its weight of a molten fluoride flux less dense than the alloy and having a boiling point above the alloy's liquidus temperature, then permitting the stirred mixture to stand to settle out a molten alloy in which the titanium content is reduced but not entirely eliminated, and separating the settled out alloy from the flux.

2. The method of claim 1 in which the flux is essentially one of the following:

a. cryolite, b. a combination of an aluminum fluoride with one or more salts of an alkali metal having an atomic number of 3 to 19 and a halogen having an atomic number of 9 to 17, or c. a combination of cryolite with sodium chloride and/or potassium chloride.

* * * * *